US005132684A

United States Patent [19]

Pecker et al.

[11] Patent Number: 5,132,684

[45] Date of Patent: Jul. 21, 1992

[54] TRAFFIC INFORMATION SYSTEM

[76] Inventors: Edwin A. Pecker, 5003 Showboat Pl., Culver City, Calif. 90230; Robert M. Woskow, 16801 Severo Pl., Encino, Calif. 91436

[21] Appl. No.: 653,249

[22] Filed: Feb. 11, 1991

[51] Int. Cl.[5] ..... G08G 1/09

[52] U.S. Cl. ..... 340/905; 340/990; 340/995; 340/525; 340/539; 340/286.13; 340/286.14

[58] Field of Search ..... 340/905, 990, 995, 525, 340/286.13, 286.14, 539; 364/424.02, 436

[56] References Cited

U.S. PATENT DOCUMENTS 3,760,360 9/1973 Reynolds et al. ..... 340/995
4,937,570 6/1990 Matsukawa et al. ..... 340/905
5,020,143 5/1991 Duckeck et al. ..... 340/905

FOREIGN PATENT DOCUMENTS 0085013 8/1983 European Pat. Off. ..... 340/905
9005969 5/1990 World Int. Prop. O. ..... 340/905

*Primary Examiner*—Donnie L. Crosland
*Attorney, Agent, or Firm*—Gilbert Kivenson

[57] ABSTRACT

A system for encoding, multiplexing and transmitting traffic congestion data is disclosed. The invention utilizes a master display map on which traffic conditions are represented by condition indicators. A similar, smaller-scale map and indicator display is carried by individuals and in vehicles, reproduces the information appearing on the master map.

6 Claims, 4 Drawing Sheets

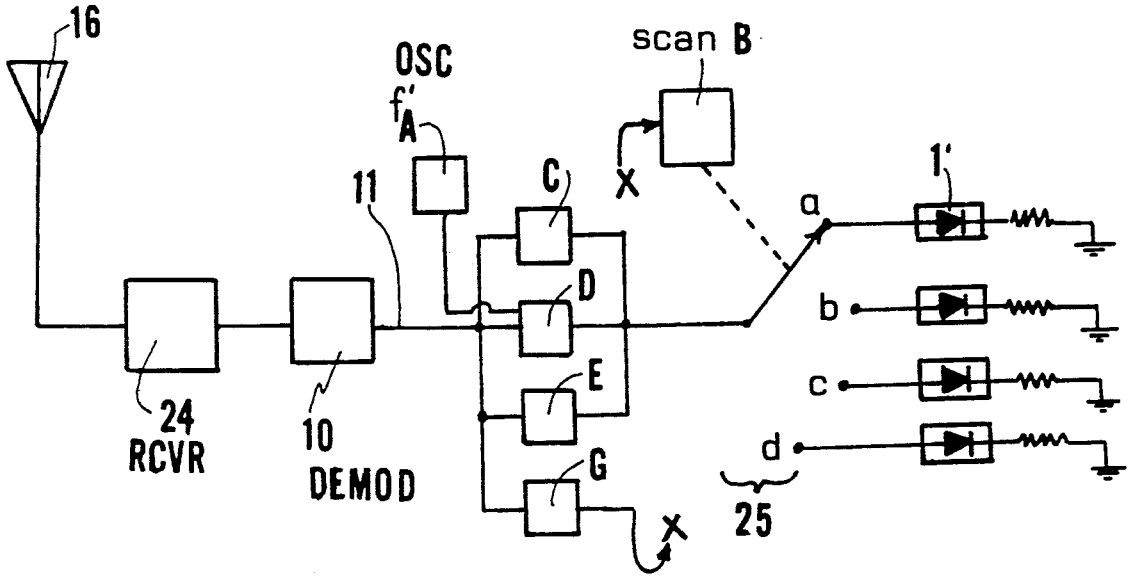
FIG. 5
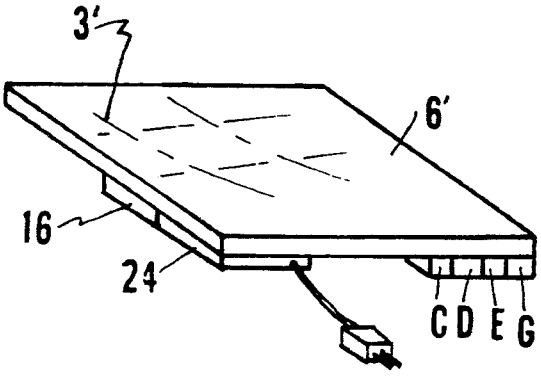
FIG. 6
| OSC. NO. | FREQ. |
|---|---|
| $f_0$ | DC |
| $f_A$ | 2 HZ |
| $f_B$ | 10 |
| $f_C$ | 500 |
| $f_D$ | 700 |
| $f_E$ | 900 |
| SCAN A,B | 1 K |
| $f_S$ | 1.5 K |
FIG. 7

TRAFFIC INFORMATION SYSTEM

BACKGROUND OF THE INVENTION

The present invention relates to a display system for traffic information which may be used by vehicle operators to plan or modify an intended route. This information allows a driver of a vehicle to so adjust his itinerary as to avoid heavy congestion caused by accidents, the "letting out" of large gatherings, construction roadblocks and other conditions which modify or disrupt the steady flow of traffic. The congestion problem has long been recognized in many cities of the world; various systems have been conceived to minimize the effects of traffic blockage as it affects an individual driver. These systems have been complex, subject to interference and required the installation of expensive equipment.

A number of systems in the prior art (such as Dahan, U.S. Pat. No. 4,398,171) utilize a television-like screen mounted in the vehicle as a means of displaying traffic information. A map of the city appears on the screen; this map is a repetitive pattern which has been stored in memory elements in the screen circuit. Traffic conditions are monitored by TV cameras mounted above the roads of the city. Signals from the cameras are converted to suitable codes, processed by a computer, and transmitted to a receiver in each vehicle. Suitable symbols are then generated and appear at their proper positions on the map.

In other systems (for example, Madnick et al U.S. Pat. No. 4,792,803 or Pfennighausen et al U.S. Pat. No. 3,283,297) a large number of sensors are buried under roadways or mounted alongside of them. Various parameters such as the number of cars per lane per unit time, the average speed of vehicles along each road, the presence of moisture or fog, etc. are measured and processed in a computer. When conditions are judged to be congestion-producing, various signals are generated and transmitted by radio to those vehicles equipped with the system. This enables the driver in many cases to circumvent the slower traffic.

Perhaps the most popular system in use involves interrupting standard radio broadcasts with bulletins about traffic tie ups on various roads and highways. This information is obtained from helicopters flying above the city, from police accident reports and from incidental observers who report traffic jams to the broadcast station by using car telephones. Although these verbal reports are accurate and obviate the need for complex sensors and computer circuits, the information can often only be used in a limited way by the motorist. He often cannot visualize the area of tie up and therefore cannot plan alternate routes from his position in the traffic pattern.

OBJECTIVES AND SUMMARY OF THE INVENTION

One objective of the present invention is to provide a system which utilizes many of the advantages of the human observer-interpreter and the radio broadcast system. This simplifies the data gathering, summarizing and communication aspects of this complex problem, reduces the cost of installation and maximizes its reliability. The present invention makes use of a manually-tended"master board" on which is inscribed a road map of the area being monitored. Linear light sources consist—in a preferred embodiment—of light-emitting diode bars which are installed on the lines representing major roadways, freeways, off ramps, etc. The length of each bar will vary depending on the length of road it represents. On lightly travelled roads with relatively few cross streets, for example, the bars will be long. Complex roadways and by-passes will be represented by many, shorter bars.

A board attendant listens to information from helicopter spotters, police accident reports and radio stations. The attendant operates a large number of three way(or other multiple) switches, each controlling a single light bar. In the first position of a three way switch, for example, a light bar glows continually. This would indicate that the particular roadway represented by that bar is being monitored and that the traffic flow is normal. In the second position of the switch the bar flashes at a slow rate. This would indicate the onset of reduced traffic flow. The third position of the switch produces a more rapid flashing of the light bar which indicates extreme traffic congestion or stoppage. The condition of each switch is interrogated by a sampling device which then sends a suitably modulated radio signal to a transmitter. In each vehicle in which the invention is used there is a small display unit consisting of a small copy of the master board containing illuminated strips such as light bars indicating segments of the key roads. The flashing rate of each light bar on the master board is thus reproduced on the display so that the operator of the vehicle can quickly determine the exact location of each congested area and can plan a by-pass strategy. The information is continuously updated.

The display board is not confined to use in the vehicle but may be removed and used as a portable monitor of traffic conditions. It would thus be possible for a driver to park and attend to other business while carrying the portable monitor with him. He could readily determine when a particular jam had cleared. An important use of the invention would be to plan a route before the start of a trip and then to modify it along the way so as to take advantage of changing conditions.

DESCRIPTION OF THE DRAWINGS

FIG. 5 is a schematic of the receiving circuit of the present invention as it would be used in each vehicle showing the frequency selective circuits, the local flashing means, the synchronized sampler and the repeater light bars.

FIG. 6 is a perspective view of an individual display unit as it would be supplied to each user.

FIG. 7 is a table of frequencies which might be used with the invention.

DETAILED DESCRIPTION OF THE INVENTION

Figure 1:
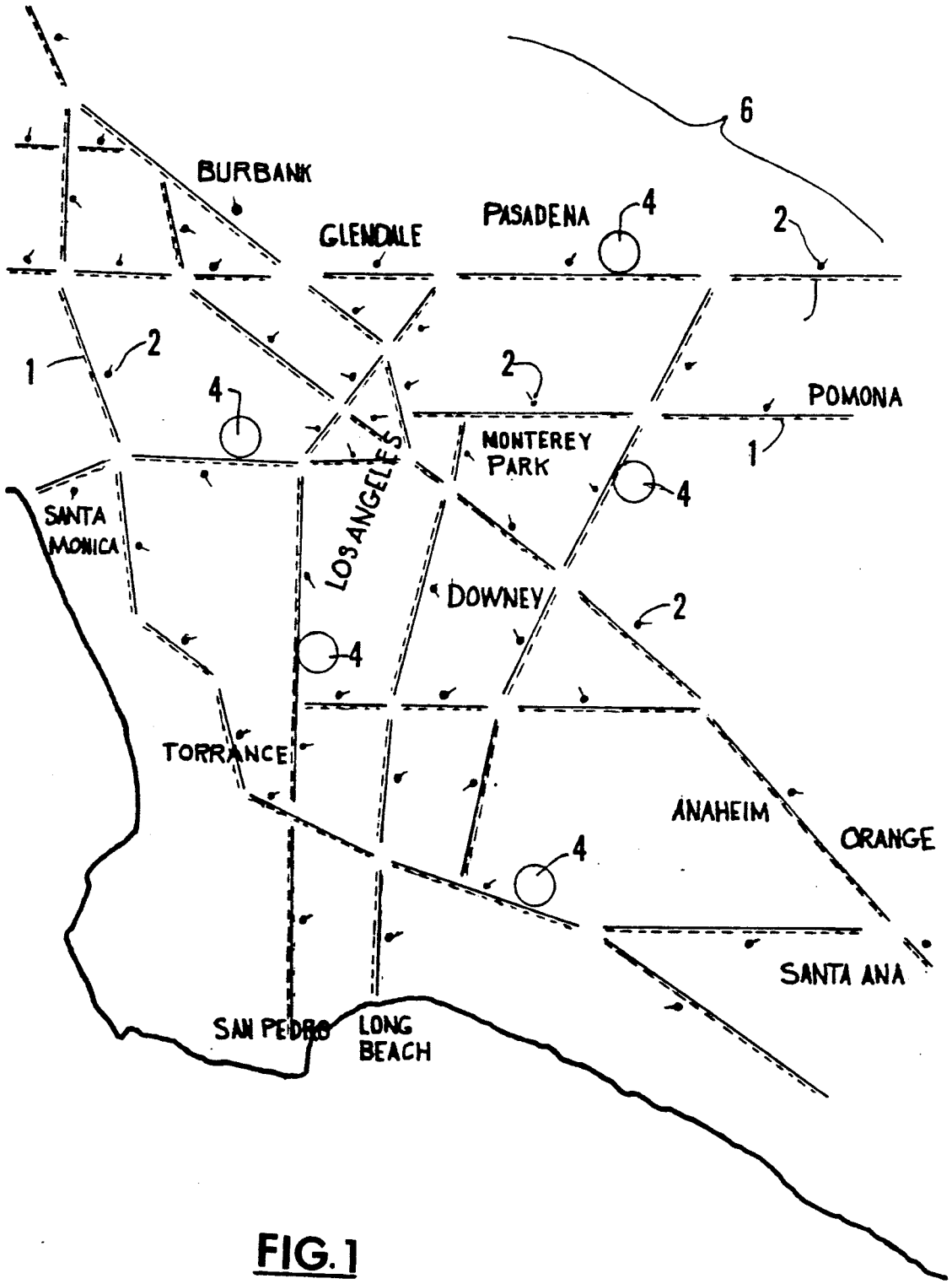
FIG. 1 illustrates a layout of a master board as used in the present invention. The general map in this case corresponds to the freeway system of the Los Angeles area.

In FIG. 1 a master board 6 is imprinted with a map of the Los Angeles area showing the major freeways which are the main transportation arteries of that region. Along the line representing each roadway are one or more light emitting bars 1. Each emitting bar is served by its own three position switch 2. The roadways themselves are marked by their route signs 4. An attending operator moves each switch to one of three positions. In position 1 the corresponding light-emitting bar glows steadily; in position 2 it flashes at a low rate while in position 3 the flashing rate is increased. If the bar is dark, it indicates that there is a fault in the local circuit. If the entire board is dark, there is a fault in the overall system. Other coding is readily possible with the invention. More or fewer switch positions can be utilized as well as bars of differing colors to increase or decrease the number of traffic conditions which can be represented by the operator.

Figure 2:
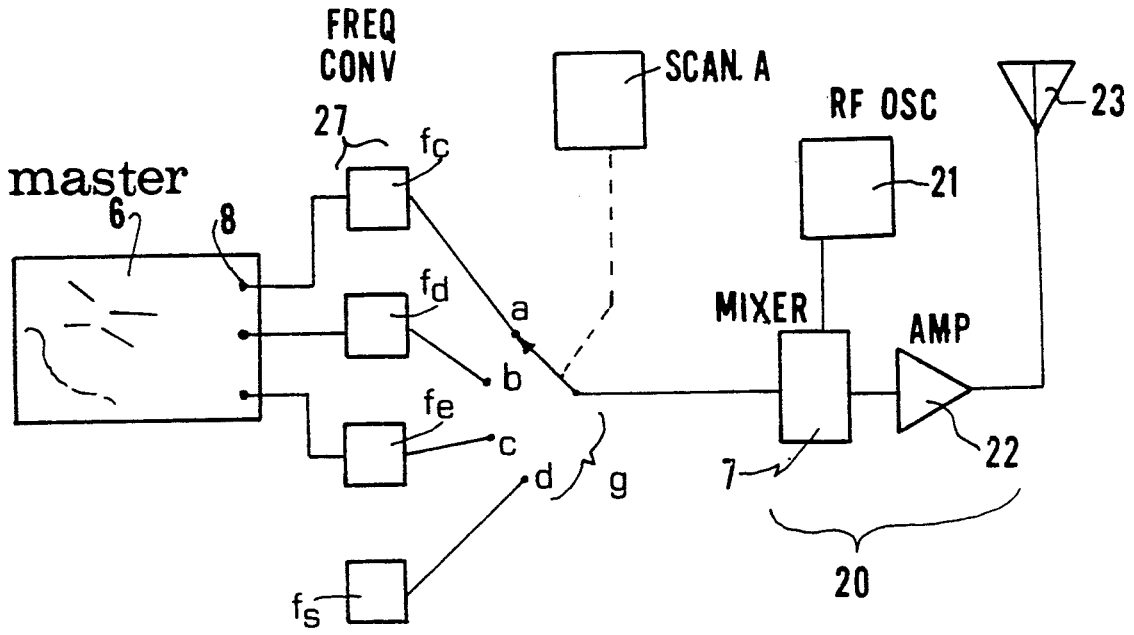
FIG. 2 is a block diagram of the transmitting portion of the invention showing the master board, the scanning and the transmitting system.
Figure 3:
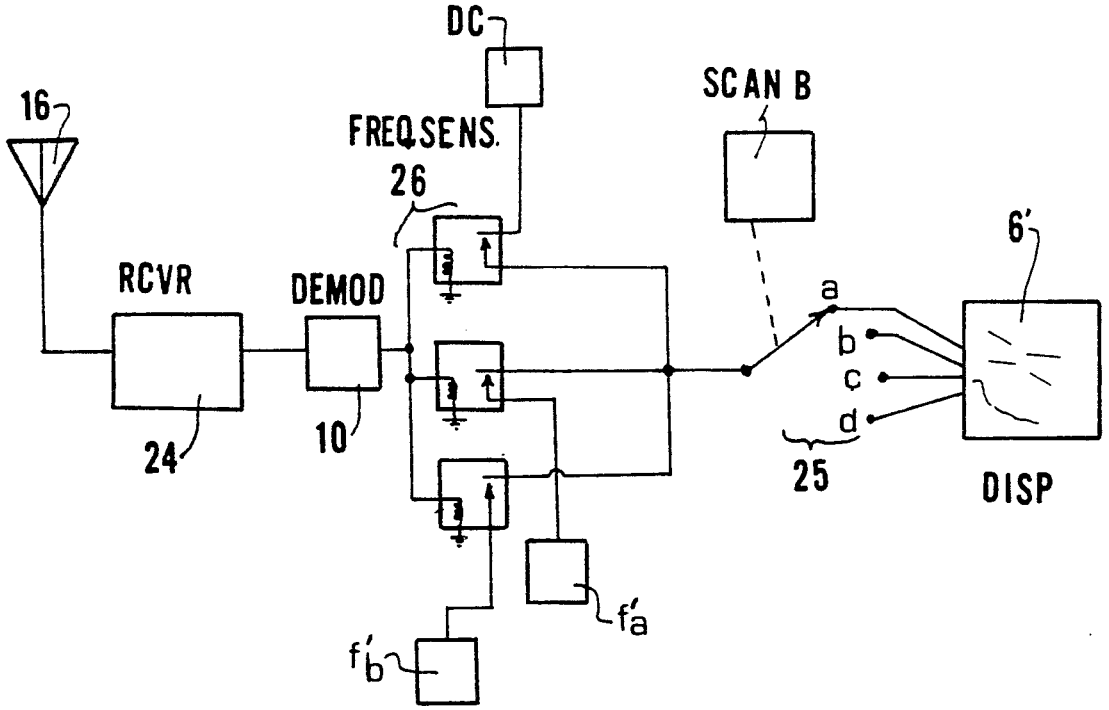
FIG. 3 is a block diagram of an individual receiving system showing the filtering, frequency-selective and scanning arrangements and a display board.

In FIGS. 2 and 3 are block diagrams of the transmitting and receiving systems. From each of the terminals 8 of the master board 6 there emanates a constant, a slow-pulsing or a rapidly-pulsing signal which corresponds to one of three conditions selected by the operator. These signals are coded in converters 27 to higher frequencies suitable for the modulation of radio frequency power and applied to terminals 9. A first scanner A samples each of the terminals 9*a*, 9*b*,9*c*,etc connecting them successively to the mixer circuit 7 which modulates a radio frequency carrier. The modulated carrier is amplified in 22 and radiated by antenna 23 as is known in the art.

The modulated carrier is detected by a dedicated receiver 24 (FIG. 3) which is part of the display board system. The latter may be mounted in a vehicle or is used at a fixed location. The coded flash signal is recovered by the demodulator 10 which removes the carrier. The frequency sensitive relay bank 26 selects the coded signal which corresponds to the one being transmitted at that moment causing the signal to appear at terminal 25*a*,25*b*, 25*c* or 25*d*. These terminals are sampled by a second scanner B which is synchronized with first scanner A in the transmitting portion of the invention. Thus when a steady, slow-flashing or rapid flashing bar appears on the master board, a corresponding element is energized on the display board.

Figure 4:
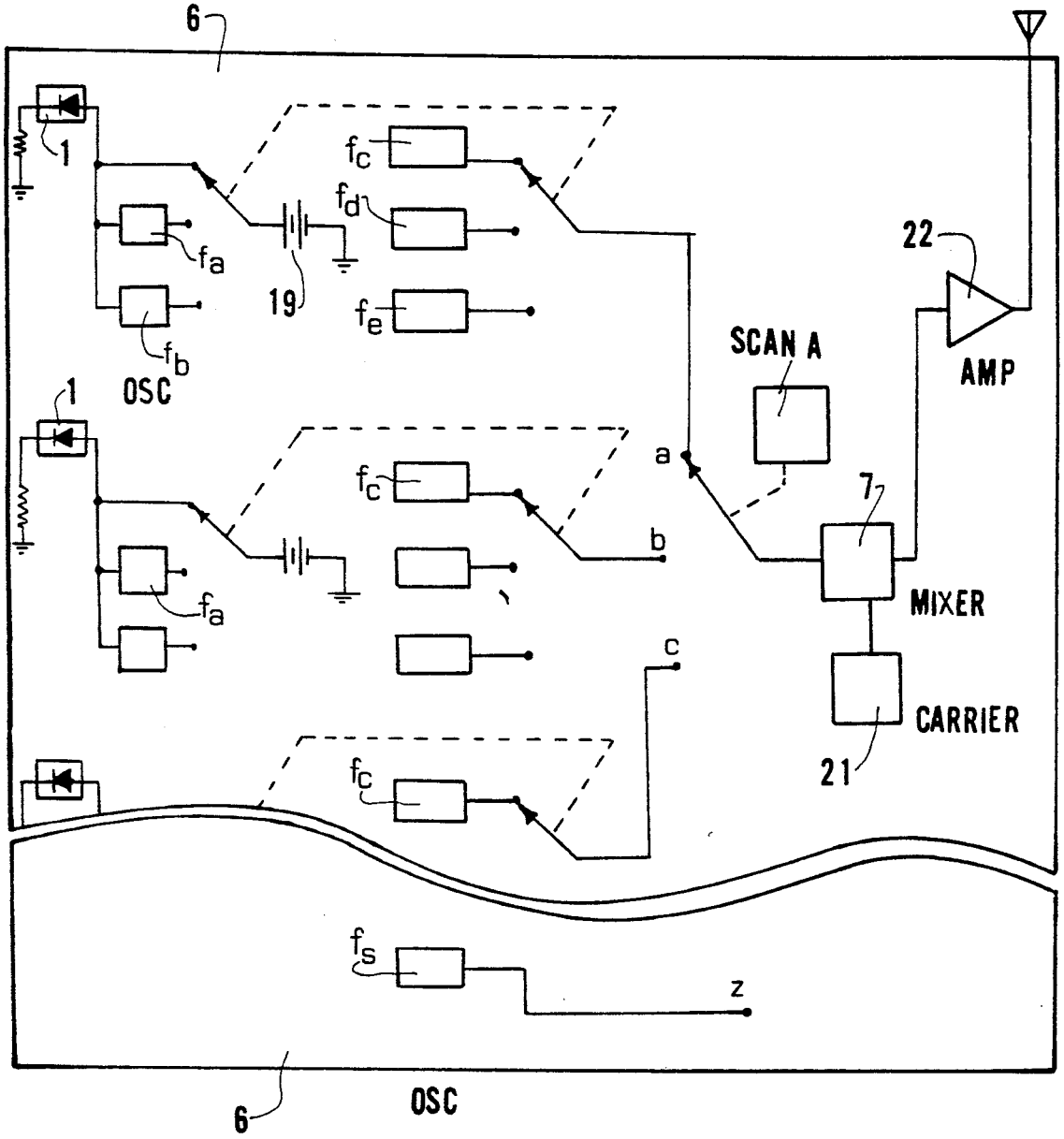
FIG. 4 is a schematic of the individual light bars, their flashing arrangements and their encoding systems. Also shown in FIG. 4 are the sampling system, the synchronizing method and the radio transmitter.

In FIG. 4 the circuit arrangement of the master board is shown in greater detail. Each light emitting bar 1 is directly energized by a power supply or battery 19 by means of the first deck position of the switch 2. In its second position switch 2 activates oscillator fA which applies a slow pulsating current to its light emitting bar. In its third postion the switch activates oscillator fB which provides a more rapidly pulsating current to the light emitting bar. Thus the operator can form a traffic condition map and keep it current from information received from helicopters and other sources. A second deck 2*a* is used to electrically indicate the switch position of the first deck. When the latter is in the "steady'-'illumination position, e.g. the second deck connects oscillator fC to the mixer 7. Radio frequency power from oscillator 21 is modulated by oscillator fC and emitted as a radio signal. Each switch position in the upper deck is sampled at a frequency $f_G$ by the scanner A. As the scanner arrives at points a, b, c, etc. the position to which each part of the lower deck is turned thus determines the modulating frequency to be applied to the carrier. At the last position of each scan z, the sampling drive connects a synchronizing frequency $f_S$ to the mixer.

The circuit of each display unit is shown in FIG. 5. The dedicated receiver 24 tunes the carrier signals modulated by the various frequencies. The operation of the demodulator and frequency sensitive relay bank was explained above. If, at a particular moment of sampling, a particular illuminated bar was flashing at its slow rate,e.g., then the signal at point 11 would have a frequency of $f_D$ (originating from oscillator fD in that illuminated bar's circuit—FIG. 4). This would cause relay D to trip and connect the slow flashing oscillator fA to a corresponding "repeater" light bar on the display board. The sampler B on the display board moves at exactly the same speed as the sampler A in the master board circuit. When sampler A reaches the end of its travel and is about to reset, it transmits the synchronizing signal $f_S$ to the transmitter 20; when the sampler B in the display unit reaches the end of its travel (FIG. 5), it stops. A signal of frequency $f_S$ from the demodulator 10 triggers relay G which resets and restarts sampler B. In this way the samplers A and B are maintained in synchronism. The condition of each light bar(continously lit, slow flash or rapid flash) is thus reproduced at its proper position in the display.

The display unit, shown in FIG. 6, consists of a board 6' on the surface of which is the street map 3'. Each light bar on the master board is duplicated on the display. The dedicated receiver 24, antenna 16 and a set of frequency selective relays C,D,E and G are also incorporated in the display. A plug-in power supply, local battery and connections to a car battery are options. The display unit is thus completely portable and operable at any location.

FIG. 7 is a table of possible frequencies which might be employed with the invention. The lowest flash frequency is 2 hertz. This is readily distinguishable by eye from 10 hertz. Modulation frequencies $f_C$, $f_D$ and $f_E$ differ from each other by 200 hertz so that they can readily be distinguishable from each other by the frequency selective relays. The scan frequency $f_S$ is 1000 hertz which is high enough to be non-interfering with the low audio flash frequencies of the light emitting bars. Synchronizing frequency $f_G$ is 1500 hertz is easily selected from the others by relay G and does not interfere with the other operating frequencies. The radio frequency chosen would depend on availability and the type of emission used.

The invention as described is a general embodiment of the system. The switching arrangement for constant or flashing illumination of the light bars can be mechanical or make use of solid state devices. The samplers A and B and the multiple switches 9*a*, 9*b*, 9*c*, etc. and 25*a*, 25*b*, 25*c*, etc. are preferably solid state. The transmitter-receiver system could use AM,FM, pulse or burst modulation. The receiver may be of the self-seeking type which continuously tunes a band of frequencies and locks on one signal which contains a keying frequency. The emission of the transmitter can be general or coded so as to be useable, in the latter case, only by those in a subscriber network system. The light bar modules (light emitting diodes) described above may be replaced by other display devices e.g. neon tubes, light bars of differing colors, multisegment LED bar graphs arranged so that the length of the illuminated portion indicates traffic density. Incandescent, electroluminescent and fluorescent light sources are among other possibilities. Many of the light sources mentioned are available form Newark Electronics Corporation of Chicago or from Allied Electronics of Elgin, Ill.

The system need not be confined to a single master board and numbers of identical, small scale displays. Where large areas are to be monitored, a regional map may be divided into a number of adjoining masterboards. The receiving units would then consist of a number of displays mounted together in notebook fashion. Coded signals emitted by the transmitter would illuminate corresponding lamps on the displays to indicate which one was applicable at any given time. Lighted arrows next to roadways could be used to indicate the direction of congested traffic.

A computer system can also be used to achieve some or all of the functions described above. Information applied to the master board can be made part of a variable data base which is scanned at regular intervals. Changes are transmitted to the various displays where a second scanning system activates the light bars and duplicates the changes.

The following is claimed:

1. A traffic information system which utilizes road congestion data received by an operator then encoded and transmitted by radio to individual receivers comprising:

(a) a master board containing on its surface a map of the major roadways in a region, said map being provided with indicators at various points along each roadway, each indicator being connectable by the operator to one of a number of signal sources so that the degree of congestion can be represented by various frequencies of operation of that indicator;

(b) encoding means for each indicator to allow its frequency to be translated into a modulation frequency for a radio transmitter;

(c) multiplexing means to sample the modulation frequency of each indicator and apply it to said radio transmitter;

(d) independently powered receiving assemblies on the surfaces of which appear maps and indicators which duplicate those of the master board;

(e) a circuit contained in each receiving assembly which includes a radio receiver, decoding and demultiplexing means to connect each duplicate indicator with a decoded signal;

whereby traffic density and congestion information acquired by the operator is transmitted to all of the individual receiving assemblies with the result that those possessing the said assemblies can be apprised continously of traffic conditions.

2. A traffic information system as described in claim 1 in which said light indicators are illuminated devices selected from the group consisting of light emitting diodes, light emitting bars, fluorescent bulbs, liquid crystal displays and electoluminescent strips

3. A traffic information system as described in claim 1 in which the encoding means are a group of oscillators which can be switched into a modulating circuit which is part of a radio transmitter, the modulating frequency chosen to correspond to the flashing rate of the indicator whose state is being monitored.

4. A traffic information system as described in claim 1 in which the multiplexing means is an automatically switched sampling circuit which sequentially connects the encoded output of each indicator to the radio transmitter.

5. A traffic information system as described in claim 1 in which the demultiplexing means is an automatically switched sampling circuit which sequentially connects power in each receiving assembly to the appropriate duplicate indicator in synchronism with the multiplexing means connected to the master board.

6. A traffic information system as described in claim 1 in which the indicators are of various colors and the encoding means includes the use of a particular color to correspond to a particular traffic density.

* * * * *